United States Patent [19]

Zebelean

[11] 4,214,754

[45] Jul. 29, 1980

[54] METAL GOLF DRIVER AND METHOD OF MAKING SAME

[75] Inventor: John Zebelean, Oxnard, Calif.

[73] Assignee: Pro-Patterns Inc., Ventura, Calif.

[21] Appl. No.: 872,092

[22] Filed: Jan. 25, 1978

[51] Int. Cl.[2] ..... A63B 53/04

[52] U.S. Cl. ..... 273/167 H; 273/167 F; 273/171

[58] Field of Search ..... 273/77 R, 80 C, 167–175

[56] References Cited

U.S. PATENT DOCUMENTS

| | | | |
|---|---|---|---|
| 1,167,106 | 1/1916 | Palmer | 273/171 |
| 1,269,745 | 6/1918 | Robertson | 273/172 |
| 1,526,438 | 2/1925 | Scott | 273/169 X |
| 1,568,888 | 1/1926 | Dunn | 273/169 X |
| 1,582,836 | 4/1926 | Link | 273/167 H |
| 1,616,920 | 2/1927 | Pedersen | 273/169 X |
| 2,171,383 | 8/1939 | Wettlaufer | 273/171 |
| 2,447,967 | 8/1948 | Stone | 273/164 X |
| 3,191,936 | 6/1965 | Guier | 273/164 X |
| 3,212,783 | 10/1965 | Bradley et al. | 273/167 F X |
| 3,941,390 | 3/1976 | Hussey | 273/169 |
| 3,967,826 | 7/1976 | Judice | 273/167 F |
| 3,976,299 | 8/1976 | Lawrence et al. | 273/167 F X |
| 3,995,865 | 12/1976 | Cochran et al. | 273/171 X |
| 4,021,047 | 5/1977 | Mader | 273/167 H |
| 4,063,737 | 12/1977 | Tom et al. | 273/174 |

FOREIGN PATENT DOCUMENTS

| | | | |
|---|---|---|---|
| 211781 | 12/1957 | Australia | 273/167 H |
| 371974 | 5/1932 | United Kingdom | 273/167 F |
| 398643 | 9/1933 | United Kingdom | 273/167 H |
| 679292 | 9/1952 | United Kingdom | 273/167 H |
| 1476889 | 6/1977 | United Kingdom | 273/167 H |

OTHER PUBLICATIONS

"Golf World," Feb. 23, 1973, p. 27.

*Primary Examiner*—Richard J. Apley
*Attorney, Agent, or Firm*—Freilich, Hornbaker, Wasserman, Rosen & Fernandez

[57] ABSTRACT

An all metal hollow golf driver is formed by casting a first main part from metal, e.g., stainless steel, in the shape of practically a complete golf driver, except for an opening in one side of the driver body, e.g, the sole side. A second cast part fits within the opening and is weldable thereto to form a complete integral hollow metal golf driver. The weight (mass) of the driver is distributed in order to reduce its torque and/or deflection.

18 Claims, 13 Drawing Figures

FIG. 1
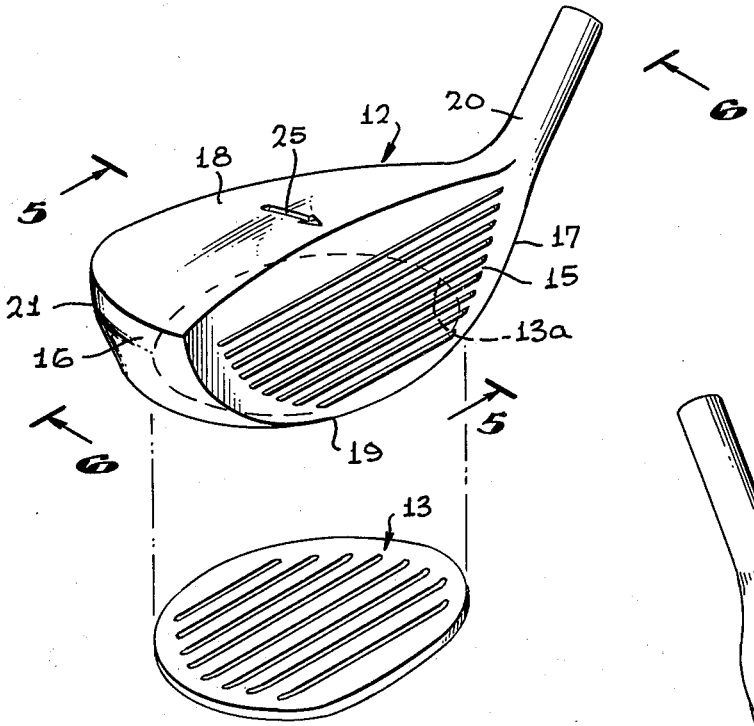
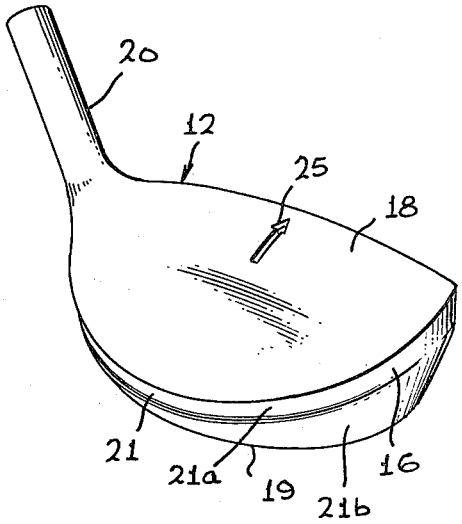
FIG. 2
FIG. 3
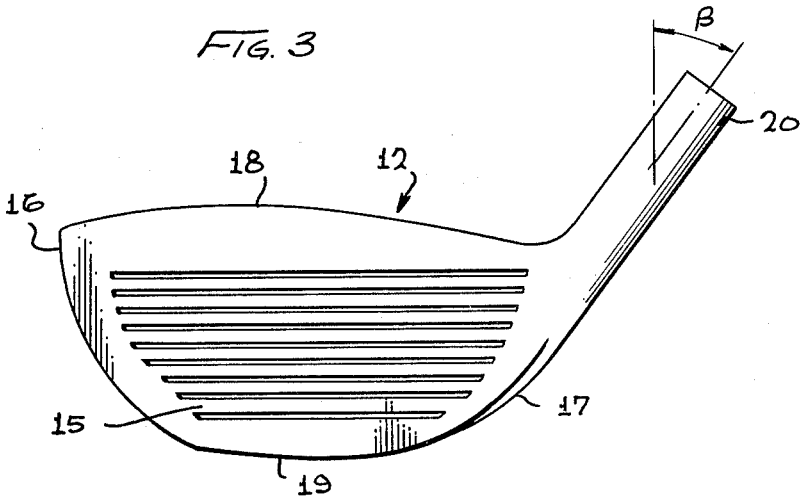

FIG. 4
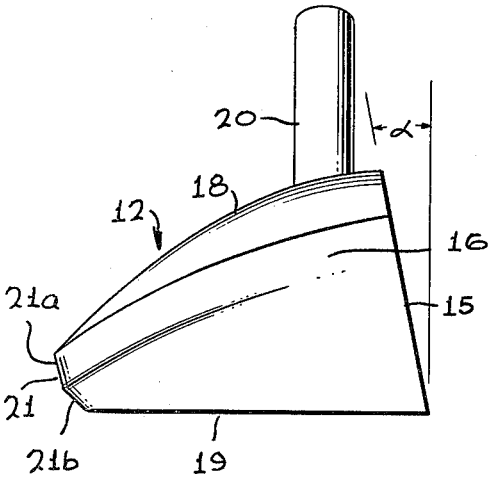
FIG. 7
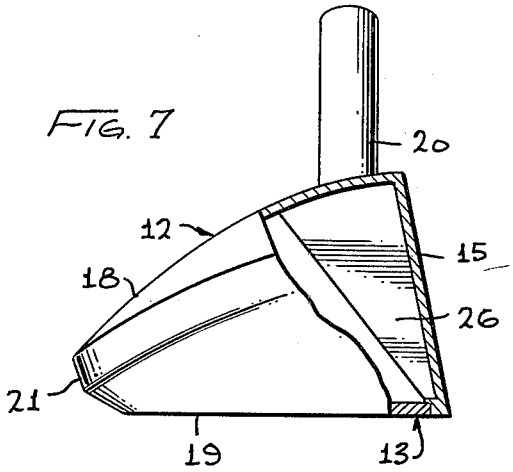
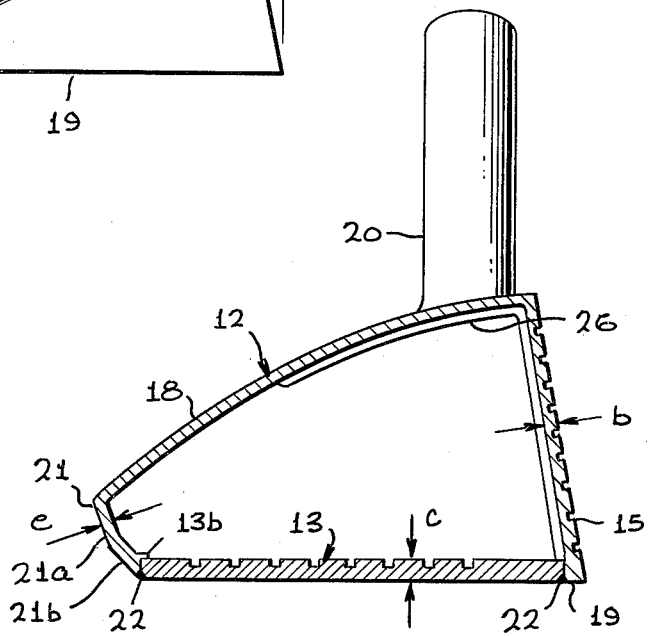
FIG. 5
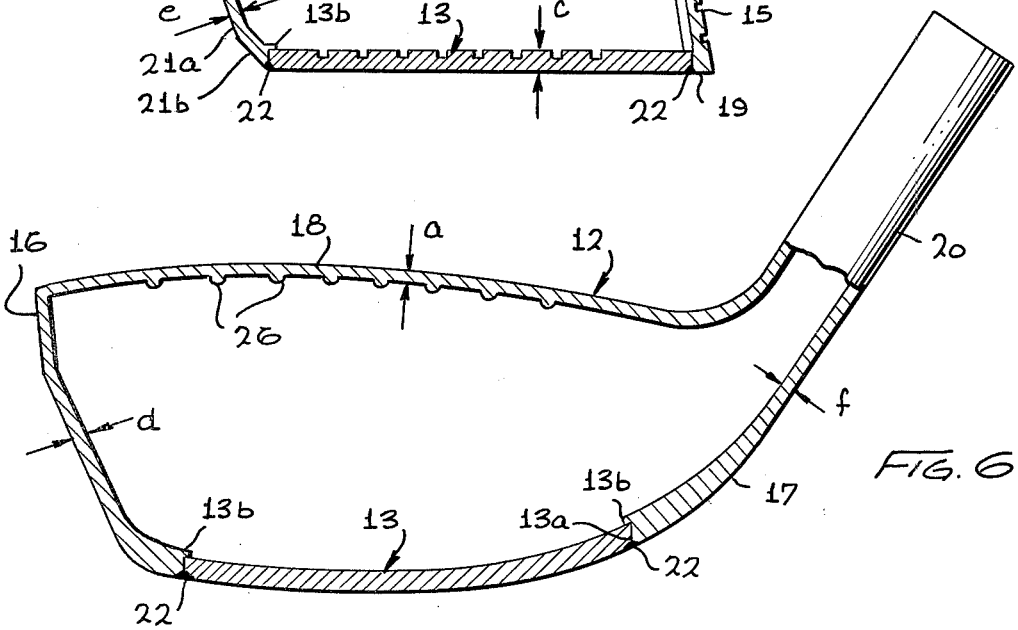
FIG. 6

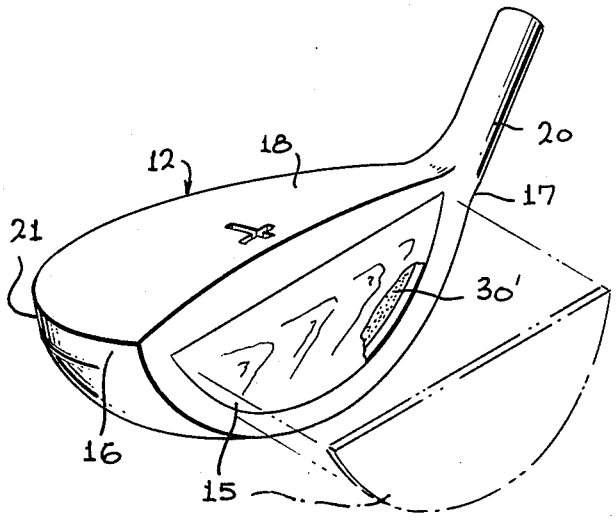
FIG. 9
FIG. 10
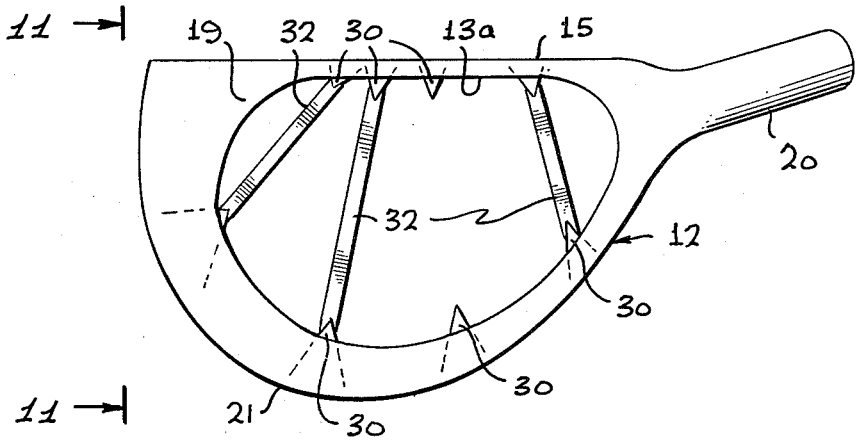
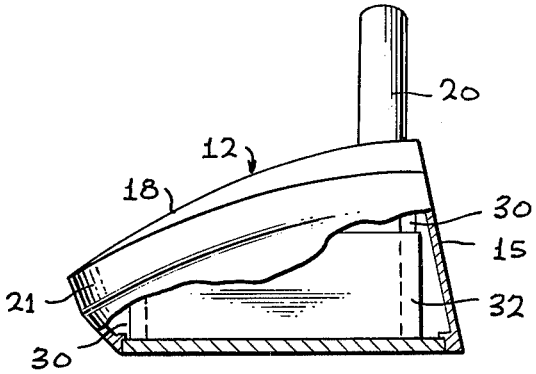
FIG. 11

FIG. 8
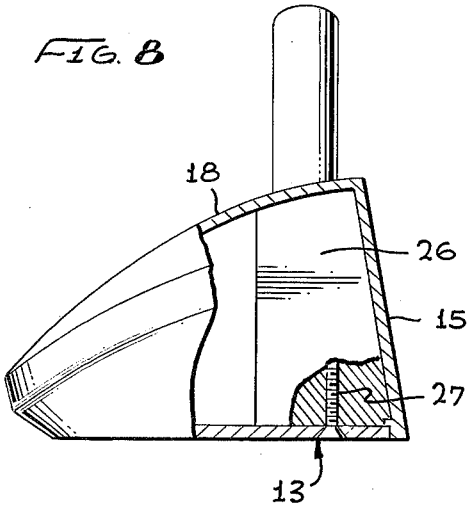
FIG. 13
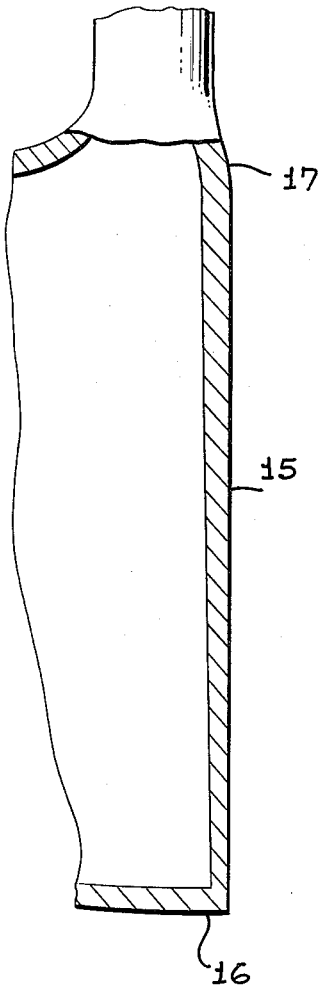
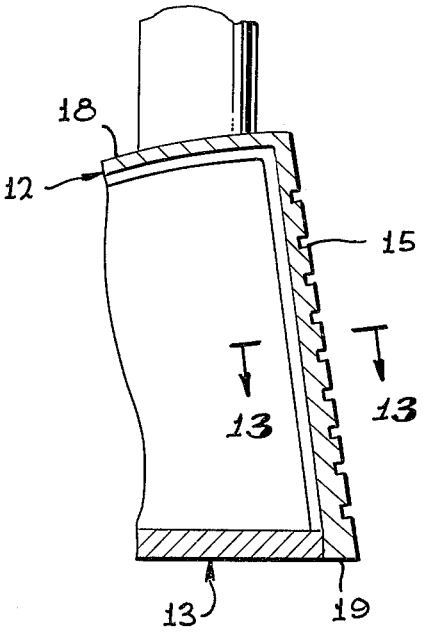
FIG. 12

METAL GOLF DRIVER AND METHOD OF MAKING SAME

BACKGROUND OF THE INVENTION

1. Field of the Invention

The present invention generally relates to golf clubs and more particularly, to golf drivers.

2. Description of the Prior Art

Golf clubs are generally divided into three main classes. These include the putters, the irons, and the drivers. Since the heads of the latter are typically made of wood, they are often referred to as the wood drivers or simply as the woods. They are typically used by most golfers to drive off the tee toward the hole. The head of a wood driver is formed from an appropriately-shaped piece of solid wood, from which a neck extends to accommodate the club's shaft.

Although wood drivers are used by practically all golfers they suffer from a number of very significant disadvantages. The wood tends to chip, become scratched or otherwise disfigured when impacted by sharp objects, which is undesirable. A metallic sole plate is typically attached to the wood head. Despite the advanced means which are used to fasten the sole plate to the wood head, the sole plate tends to become loose and therefore requires repeated servicing. Also, once a wood head is shaped, and each has to be shaped separately, its properties, such as its lie and loft, are fixed and are not capable of being adjusted. Furthermore, the total weight of the wood head, once shaped, remains fixed and unalterable.

These limitations prevent a golfer, who owns a set of wood drivers which are quite expensive, from modifying some of the woods' properties to suit his personal golfing habits and needs. Frequent use of the woods increases their scratching and disfigurement, and necessitates repeated maintenance to resecure the sole plates. Also, due to the fact that wood drivers are shaped of solid wood, there is no way of compensating for torque and deflection which occur when the wood is used to drive a golf ball.

OBJECTS AND SUMMARY OF THE INVENTION

It is a primary object of the present invention to provide a new golf driver which is not made from substantially a solid block of wood.

Another object of the present invention is to provide a golf driver which is not made of a solid block of material and whose lie and loft are adjustable.

Yet another object of the present invention is to provide a golf driver which is practically immune to chipping and with a sole plate which is an integral part of the driver and is a permanent part thereof.

A further object of the present invention is to provide a golf driver with an integral, permanently secured sole plate, and whose loft and lie are adjustable within limits and which is substantially immune to scratching when impacted by sharp objects.

Yet a further object of the present invention is to provide a new method of fabricating an improved golf driver.

These and other objects of the present invention are achieved in one embodiment by forming a metallic golf driver which is hollow inside, so that the entire weight (mass) of the driver consists of the weight of its various sides and the neck extending therefrom. Preferably, the hollow metallic golf driver is formed by casting the metal in the desired hollow shape. The mold, from which the drivers are cast, is shaped so that the various walls or sides of the driver have specifically selected thicknesses to optimize the performance of the driver without excessively increasing the total driver weight. As will be pointed out hereafter, by increasing the thickness of the driver's toe and sole or bottom side, reduced torque and deflection are achievable. Also, since the driver is of metal, the neck orientation with respect to the driver body can be adjusted to vary, within limits, the driver's lie and loft. Since the driver is of metal it is practically chip free. Also, the driver's sole is an integral part thereof and therefore it cannot separate itself from the rest of the driver body.

The novel features of the invention are set forth with particularity in the appended claims. The invention will best be understood from the following description when read in conjunction with the accompanying drawings.

BRIEF DESCRIPTION OF THE DRAWINGS

FIGS. 1 and 2 are isometric views of one embodiment of the invention;

FIGS. 3 and 4 are different views of a golf driver in accordance with the present invention;

FIGS. 5 and 6 are cross-sectional views along lines 5—5 and 6—6 in FIG. 1;

FIGS. 7 and 8 are side views with portions of external sides removed to reveal internal structure;

FIG. 9 is an expanded isometric view of another embodiment of the invention;

FIGS. 10 and 11 are respectively a side view of the driver as viewed from the sole side, and a cross-sectional view along lines 11—11;

FIG. 12 is a partial view, similar to FIG. 5 as shown; and

FIG. 13 is a partial sectional view taken on line 13—13 of FIG. 12.

DESCRIPTION OF THE PREFERRED EMBODIMENTS

Attention is first directed to FIGS. 1 and 2 which are isometric views of a preferred embodiment of the present invention, comprising a golf driver head, or simply a driver 12. Unlike all prior art golf drivers, golf driver 12 is made of an enclosed metal body, whose features will be described subsequently in more detail in connection with FIGS. 5 and 6, which are cross-sectional views along lines 5—5 and 6—6 in FIG. 1, respectively.

FIG. 1 is also an expanded view of the driver 12. A sole plate 13, which in practice is an integral part of the driver 12 is shown separated from the main driver body. The driver 12 has a face side or simply a face 15, which extends from the driver's toe portion or simply toe 16, to the heel 17 and from the driver's top side 18 to the bottom or sole side 19. The driver 12 also includes a neck 20 which extends therefrom and a back side 21. As is appreciated, the neck is adapted to receive the shaft of the golf driver.

The driver 12, shown in FIG. 1 and the related figures, is an all metal enclosed hollow driver with very significant advantages, as will be detailed hereafter. The particular embodiment was reduced to practice by casting the driver 12 from an appropriate metal, e.g., stainless steel (S.S.) 431 or 17-4. The driver was cast of two parts, as shown in FIG. 1, with practically the entire driver as a first or main part and the sole plate 13 as the second part. The main casting part has an opening 13*a*, which is formed therein to enable the part to be cast as a hollow metal body. After the casting, the sole plate 13 is used to enclose opening 13*a* and is welded thereat as shown by 22 in FIGS. 5 and 6, to become an integral part of the driver.

Preferably, the opening 13*a* is cast with a lip 13*b* (see FIG. 5) to facilitate the alignment of the sole plate 13 in the opening 13*a*. Also, the opening is preferably somewhat larger than the sole plate 13 so that when the latter is welded in the opening to the sole side 19 of the driver the welding material fills the space around the sole plate 13 to insure its permanent and integral mechanical connection with the driver body. Once the sole plate is welded, and the welding joint is polished, the sole plate is indistinguishable from the rest of the driver body. Thus, the driver is a completely enclosed hollow metal body.

The all metal enclosed hollow driver has many significant advantages over the conventional wood driver. When formed of an appropriate metal, e.g., S.S. 431, it is practically chip free, is not easily scratched, and does not rust. Also, since the sole plate 13, once welded, is an integral part of the driver body, there is no danger that the sole plate will loosen itself from the rest of the body, as is the case with a wood driver with an attached metal sole plate. Furthermore, when formed from cast metal, its loft and lie may be adjusted to suit the golfer-owner's desires by adjusting the orientation of the neck 20 with respect to the rest of the body, such as by bending the neck with respect thereto. In FIGS. 4 and 3, which are side views of the driver, the loft and lie are represented by angles $\alpha$ and $\beta$, respectively. Such adjustment cannot be made with a solid wood driver, since the wooden neck cannot be bent without the wood cracking. Furthermore, any expansion or contraction of the all metal stainless steel driver is considerably less than that experienced by a wood driver due to temperature and/or humidity.

In the all-metal driver of the present invention the driver is formed so that its weight is distributed to improve the user's game. In a conventional wood driver a significant amount of weight is at the driver heel in order to strengthen the wooden neck which extends thereat. However, such weight does not improve the driver's performance. In fact, from a performance point of view less weight at the heel is desirable. In the present invention such weight is not necessary since the neck 20 is of metal which extends from a metal body and therefore does not require additional strengthening. Furthermore, in accordance with the present invention the thicknesses of the various sides or walls of the metal driver are chosen to maximize the weights (or mass) in those portions of the driver so that improved performance can be realized. By having more weight at the toe 16 the torque, which is experienced when a golf ball is hit, is reduced. Likewise, by having more weight at the sole side 19 less deflection is experienced.

In accordance with the present invention the driver is shaped so that the thickness of the toe 16 and/or the sole side 19 is greater than that of the top side 18 and/or the face 15. Controlling the thicknesses of the various sides or walls of the driver is easily achieved with the present invention since in accordance with one aspect thereof the metal driver is formed from cast metal. By forming an appropriate mold with appropriate spacings the final thicknesses of the various sides of the cast metal are easily controlled. Once the mold is completed it can be used repeatedly to produce a large number of practically-identical casts, thereby providing identically-shaped drivers. This is clearly not the case with wood drivers in which each driver is formed from a different piece of wood of different grain structure and is separately shaped. Since many cast metal drivers may be formed with a single mod, the average cost per metal driver is expected to be less than a separately machined and shaped wood driver.

Another advantage of the cast metal driver is the ability to incorporate any desired indicia thereon, generally designated by 25 in FIG. 2. This may be achieved by incorporating the indicia in the mold so that each cast driver includes such indicia. In present day wood drivers any indicia has to be engraved and/or printed on the driver as an additional manufacturing step.

From the foregoing it should thus be appreciated that the castable hollow metal driver of the present invention, particularly with non-uniform wall thickness provides many significant advantages over prior art drivers. In one particular embodiment, actually reduced to practice, cast from S.S. 431, the metal driver has the following thicknesses which are presented as an example only, rather than to limit the invention thereto. The thickness of the top side 18 represented by "a" in FIGS. 5 and 6 is on the order of 0.060 in., while the thickness of face 15 as shown by "b" in FIG. 5 is on the order of 0.80. The thickest portions of the driver are the sole side 19, represented by "c" which is on the order of 0.125 in., while the toe portion 16, as represented by "d", increases from about 0.060 near the top side 18 to about 0.100–0.125 near the sole side 19. As to the back side 21 (see FIG. 5) its thickness, as represented by "e", increases from about 0.060–0.080 in. at the edge near the top side 18 to about 0.100–0.125 near the sole side 19, particularly toward the toe 16. However, near the heel side 17 the back side thins out to about 0.60–0.80 in order to reduce the driver's weight at the heel. Also, the heel thickness as shown by f in FIG. 6 decreases from the sole side where its thickness is on the order of 0.100 to 0.060–0.080 in. near the neck 20. In the particular embodiment the neck thickness is about 0.045 in. with an ID of 0.355 and is about 1 in. in length. In casting the driver, the inside area where the neck extends from the rest of the body, may be thickened to about 0.100–0.125 for strengthening purposes.

It has been discovered that in addition to the above-described advantages the metal driver of the present invention possesses several additional advantages over the typical wood driver. The metal driver's total weight is greater than that of a wood driver of the same swing weight by several grams, on the order of 10 grams, which is highly desirable. For example, a metal driver was cast from S.S. 431 with thicknesses in the ranges herebefore described with a swing weight of D0 weighed about 202–203 gr. A comparable wood driver with a swing weight of D0 weighs about 191–194 gr. The particular metal driver of the invention had a volume of 6.419 cubic inches, while the volume of the metal only, excluding the hollow space was 1.572 in.$^3$.

In the particular embodiment, which was reduced to practice, the back side does not curve continuously from the top to the sole sides. Rather it has an upper portion 21*a* (see FIGS. 2 and 5) which is nearly perpendicular to the top side 18 and a lower portion 21*b* which curves toward the sole side. It has been found that such a shape of the back side may improve the driver's expected performance.

As previously pointed out, the driver's weight is concentrated in the toe to reduce torque and in the sole side to reduce deflection, while the face and top sides are the thinnest walls. In some cases it may be desirable to cast the driver so that spaced-apart rib-like members 26 (see FIGS. 5 and 6) extend internally and bridge the thin face with the top side. In FIG. 5 these members or bridges are shown as L-shaped. If desired, the bridges may be diagonally shaped as shown in FIG. 7. Furthermore, they may be rectangularly shaped, as shown in FIG. 8, extending from the top side 18 along the inner side of the face 15 toward the location of the sole plate 13. In such an arrangement the sole plate 13 may be attached to the rectangularly shaped bridges 26 by screws 27, rather than by welding it to the driver body. Since such screws are threaded into metal, the likelihood of the sole plate becoming loose is small. Also it should be appreciated that the sole plate 13, rather than being attached to the rectangularly shaped bridged by screws 27, may be welded thereto.

In the foregoing description (as shown in FIG. 1) the driver is cast of two parts, the main part being practically the entire driver body and the other part the sole plate. In all probability, all embodiments of the cast driver of the invention will be cast of two parts, which are then integrally connected, such as by welding, to form an integral driver body. Clearly more than two parts may be cast. However, this would increase the cost since more parts will have to be welded together.

The invention is not intended to be limited to a driver in which one of the cast parts is the sole plate. If desired, one cast part may consist of top side 18, the face side 15 and the neck 20, with the other part consisting of the back side, the toe 16, the sole side 19 and the heel 17. However, in such an embodiment the welding seam would be considerably longer than in the case of the separate sole plate.

In another embodiment, as shown in FIG. 9, one of the two cast parts may be the face side 15 which can then be welded in place. Since most golfers are used to wood drivers which produce a particular sound when hitting the ball, typical of wood hitting a solid object, if desired, the face 15 may be formed of a selected wood or hard plastic which can then be screwed or otherwise attached to the hollow metal driver. With such a driver, the sound, upon impacting a ball, would be closer to that produced by the impact of a ball with a wood driver. Also, to reduce any unaccustomed or objectionable sounds, due to the hollowness of the metal driver, if desired, it may be filled with a hardening liquid, represented in FIG. 9 by 30'.

Except when filled with a hardening liquid, such as liquid 30', the driver is hollow. Therefore, part of the unoccupied space may be used to locate therein inserts of selected shapes and weights and thereby vary the driver's total weight, as well as its swing weight. This aspect may best be explained in connection with FIG. 10, which is a view of the driver 12 from the sole side 19, without the sole plate 13. The main driver part can be cast to have protrusions 30 extending inwardly from the face 15 and the backside 21. In FIG. 10 they are shown as triangular for example only. Before welding the sole plate 13, inserts 32 of desired weights and shapes may be attached to opposite protrusions 30. The inserts may be of any desired matter, e.g., wood, plastic, metal, etc. Wood or plastic inserts may be glued to the protrusions, such as with epoxy, while metal inserts may be welded thereto.

After the one or more inserts of different shapes and weights are secured at the desired different locations within the driver, the sole plate 13 is then welded to form the integral complete driver body. When such inserts are incorporated they may be in addition to or in place of the rib-like members 26, herebefore described. It should be pointed out that not all protrusions need be used. The number of inserts, their shapes and locations, are chosen, depending on the desired swing weight of the driver. It should also be pointed out that by placing inserts close to the toe, the effective total weight is increased and, therefore, less torque will be produced.

Although particular embodiments of the invention have been described and illustrated herein, it is recognized that modifications and variations may readily occur to those skilled in the art. For example, instead of having the toe and the sole side thicker than the top or face so as to reduce torque and deflection, similar effects may be achieved by controlling the face thickness to increase from the top side to the sole side as shown in FIG. 12 and from the toe toward the heel as shown in FIG. 13. Generically in accordance with the invention, the mass of the driver is distributed to optimize the mass at or near the toe to reduce torque and or the mass at or near the sole side to reduce deflection. Consequently, it is intended that the claims be interpreted to cover such modifications and equivalents.

The embodiments of the invention in which an exclusive property or privilege is claimed are defined as follows:

1. A golf driver comprising:

an enclosed all-metallic hollow body of preselected stainless steel shaped in the form of a golf driver head, defining a face side, a bottom, sole-defining side, and top and back sides extending from the upper end of said face side toward the rear end of said bottom side, said head further defining a heel and a hollow neck extending from said body at said heel at a preselected angle, and a toe opposite said heel, the mass of the metal forming said body being distributed so that the back side thickens from the heel toward the toe and from the top side to the sole side, and the toe thickens from the top side toward the sole side, so as to reduce the torque and the deflection of said driver when impacting a golf ball.

2. A golf driver as described in claim 1 wherein said body further includes internal rib means, extending internally from said face side to the top side to increase the resistance of said face side to deformation as a result of its impact with a golf ball.

3. A golf driver as described in claim 2 wherein said internal rib means comprise a plurality of spaced-apart substantially-L-shaped rib-like members.

4. A golf driver as described in claim 2 wherein said internal rib means comprise a plurality of spaced-apart triangularly-shaped rib-like members.

5. A golf driver as in claim 1 further including at least one element of preselected weights and shapes extending internally from different sides of said driver.

6. A method of fabricating a golf driver, the steps comprising:

forming n different parts, where n is an integer, said parts being shaped so that when they are secured to one another they form a substantially hollow body in the shape of a golf driver with a neck extending therefrom, at least some of said n parts being formed from castable metal; and permanently securing said n parts to one another to form a said substantially hollow body in the shape of the golf driver having a heel and an opposite toe, a top side, a back side, a front face and a bottom sole opposite said top side, the thickness of the back side increasing from the heel toward the toe and from the top side toward the sole, while the thickness of the toe increases from near the top side toward the sole, the total weight being distributed to reduce the torque and/or deflection experienced when said driver impacts a golf ball.

7. A method as described in claim 6 wherein n=2.

8. A method as described in claim 7 wherein a first of said two parts is formed of castable metal in the form of substantially the entire hollow golf driver except for an opening in one side thereof, and the second of said parts is formed to enclose said opening.

9. A method as described in claim 8 wherein said opening is the face side of said driver body and said second part is shaped to enclose said opening and to form the driver face.

10. A method as described in claim 9 wherein said second part is formed of wood or hardened plastic.

11. A method as described in claim 6 further including the step of filling with hardenable matter the substantially hollow golf driver formed when said parts are permanently secured to one another.

12. A method of fabricating a golf driver, as described in claim 6, wherein a first of said two parts is formed by casting a metal in the form of substantially the entire hollow golf driver, except for an opening in one side thereof, said first part being cast with protrusions extending inwardly from selected sides of said first part, said protrusion being located to enable inserts of preselected weights and shapes to be attached to at least some of said protrusions to control the swing weight of said golf driver.

13. A golf driver manufactured from substantially castable metal by the process comprising the steps of:

casting metal in the shape of a hollow substantially-complete golf driver including a neck which is adapted to receive a golf shaft, said hollow cast metal driver having a side defining an opening and internal protrusions for strengthening the face of the driver to minimize its deformation by impact with a golf ball, the thickness of the cast metal driver at the driver toe and at the sole is thicker than the top of the driver, and the thickness of the front face of the driver increases from the top side of the driver to its sole side and from the toe toward the heel; and securing a piece of matter to enclose said opening.

14. The process as described in claim 13 wherein said driver is cast so that the orientation of the neck with respect to the rest of the metal driver is adjustable to adjust the lie or loft of said driver.

15. The process as described in claim 14 wherein the metal is cast so that the driver's back side increases in thickness from the driver's heel toward the toe and from the top side toward the bottom sole side.

16. The process as described in claim 13 wherein the opening is in the driver sole and said matter which encloses said opening is metal.

17. The process as described in claim 13 wherein the opening in the casting is the face side of said driver.

18. The process as described in claim 17 wherein the opening is enclosed by matter forming the driver face and when impacted by a golf ball produces a sound substantially similar to that produced by the impact of a wood driver with a golf ball.

* * * * *